US008613679B2

(12) United States Patent
Zhesterova

(10) Patent No.: US 8,613,679 B2
(45) Date of Patent: Dec. 24, 2013

(54) TABLE TENNIS BAT

(75) Inventor: Lidiya Mikhailovna Zhesterova, Moscow (RU)

(73) Assignee: Start, Moscow (RU)

( * ) Notice: Subject to any disclaimer, the term of this patent is extended or adjusted under 35 U.S.C. 154(b) by 0 days.

(21) Appl. No.: 13/596,677

(22) Filed: Aug. 28, 2012

(65) Prior Publication Data

US 2013/0196799 A1 Aug. 1, 2013

(30) Foreign Application Priority Data

Jan. 27, 2012 (RU) ..... 2012102797

(51) Int. Cl.
*A63B 59/04* (2006.01)

(52) U.S. Cl.
USPC ..... 473/528; 473/529

(58) Field of Classification Search
USPC ..... 473/527–530
See application file for complete search history.

(56) References Cited

U.S. PATENT DOCUMENTS

| | | | | | |
|---|---|---|---|---|---|
| 2,311,546 | A * | 2/1943 | Hurt | 473/529 |
| 3,997,161 | A * | 12/1976 | Lemke, Jr. | 473/529 |
| D249,733 | S * | 9/1978 | Zabaldo | D21/731 |
| 4,262,903 | A * | 4/1981 | Naret | 473/530 |
| 8,371,969 | B2 * | 2/2013 | Berton et al. | 473/530 |
| 2011/0319207 | A1 * | 12/2011 | Berton et al. | 473/529 |
| 2013/0196799 | A1 * | 8/2013 | Zhesterova | 473/528 |

FOREIGN PATENT DOCUMENTS

| | | | | | |
|---|---|---|---|---|---|
| JP | 08182785 | A * | 7/1996 | A63B 59/04 |
| JP | 08215360 | A * | 8/1996 | A63B 59/04 |
| JP | 2004041370 | A * | 2/2004 | A63B 59/04 |
| JP | 2004113568 | A * | 4/2004 | A63B 59/04 |
| JP | 2005021474 | A * | 1/2005 | A63B 59/04 |
| JP | 2013017651 | A * | 1/2013 | A63B 59/04 |

* cited by examiner

*Primary Examiner* — Raleigh W Chiu
(74) *Attorney, Agent, or Firm* — Nath, Goldberg & Meyer; Jerald L. Meyer; Scott C. Langford

(57) ABSTRACT

The proposed device enables to improve cushioning properties, increase ball flying speed, improve twisting of a ball. The said technical effect is achieved owing to that the proposed bat comprises a base, a handle and an elastic pad connected to the base outer surface. Protrusions on the elastic pad are distributed evenly. The said protrusions are made T-shaped, in the form of a leg and a head combined with the said leg. The legs are connected to the elastic pad. The heads of the neighboring T-shaped protrusions are brought into contact therebetween.

11 Claims, 2 Drawing Sheets

TABLE TENNIS BAT

The invention relates to sporting appliances and may be used in table tennis bat structures.

A table tennis bat is known, which comprises a striking part made by connecting a rim to two elastic pads forming a pneumatic cavity with a handle therebetween, wherein each pad is made in two layers, the inner layer is made with cushioning protrusions, and the outer layer is provided with through holes for arranging the inner layer protrusions therein, and the layers of each pad are connected therebetween, the cushioning protrusions having holes in communication with a space between the pad layers, the pad layers being connected therebetween so as to form closed cavities around each protrusion, and the pad inner layers are made more elastic than the outer ones (U.S. Pat. No. 1,621,979).

This device enables to improve the bat cushioning properties, but it has a complex structure, the possibility of twisting is decreased significantly, and a ball flying speed (tennis ball) is also reduced.

A table tennis bat is known, which comprises a base, a handle attached to the base, an elastic pad connected to the base outer surface, the said elastic pad being made with inner partitions in the form of a cell structure covered with an elastic layer on the outside (U.S. Pat. No. 1,242,704).

This device enables to improve the bat cushioning properties, but, as compared to the previous analogous solution, the possibility of twisting is decreased even more significantly, and a ball flying speed (tennis ball) is increased only to a little degree.

The closes to the present invention is a table tennis bat comprising a base, a handle attached to the said base, at least one elastic pad connected to the base outer surface, protrusions going outwards from the pad, evenly distributed and connected to the pad (CN, No. 201154190).

Protrusions of this device are made cylindrical, and their lateral cylindrical surfaces are connected by partitions, and a longitudinal hole is made within each partition. Particular embodiments have protrusions made thickening in the outward direction (the protrusion diameter at the elastic pad is made greater than the diameter of the protrusion free end) and/or the outer free end is made beveled.

This technical solution enables to improve twisting of a ball, but a ball speed and the bat cushioning properties are reduced significantly. If the protrusion ends are made beveled, then the ball stability and control will be poorer.

The objective, which is achieved by the present invention, is to improve performance, primarily "sensing" of a ball, increase strike stability and ball control.

The technical effect that may be achieved by utilizing the device consists in improving cushioning properties, increasing ball flying speed, further improving ball twisting due to longer holding of a ball on the bat, increasing an area and a possible contact angle between a ball and the protrusions.

In order to achieve the set objective and the said technical effect, the known table tennis bat, which comprises a base, a handle attached to the said base, at least one elastic pad connected to the base outer surface, is provided with protrusions, as going outward from the elastic pad, evenly distributed and connected to the pad, are made, according to this invention, T-shaped in the form of a leg and a head, the legs being connected to the elastic pad, and the heads of the neighboring T-shaped protrusions are brought into contact therebetween.

Several additional embodiments of the device are contemplated, wherein it is advantageous that:

- the head surface facing outwards is made convex or concave;
- the T-shaped protrusion leg is made thickening in the direction of the head;
- the T-shaped protrusion legs and heads are made rectangular in their cross-sections;
- the T-shaped protrusion legs and heads are made triangular in their cross-sections;
- the T-shaped protrusion leg is made circular in its cross-section, and the T-shaped protrusion head is made triangular in its cross-section;
- the T-shaped protrusion leg is made circular in its cross-section, and the T-shaped protrusion head is made square in its cross-section;
- the T-shaped protrusion legs and heads are made square in their cross-sections;
- the T-shaped protrusions are distributed in the staggered order;
- the elastic pad and the T-shaped protrusions are made of the same material.

The said advantages as well as the specific features of the proposed utility model are explained by its best embodiments with reference to the accompanying drawings, wherein:

FIG. 1 shows an appearance of the proposed bat, when the heads are made rectangular;

FIG. 2—the same as FIG. 1, a piece of a longitudinal section (enlarged view);

Figure 1:
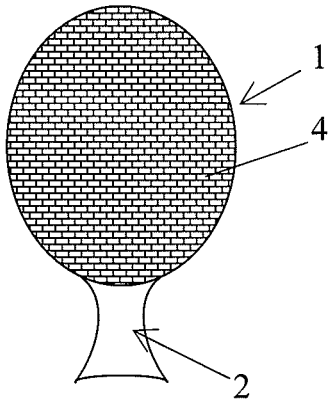

The proposed table-tennis bat (FIGS. 1, 2) comprises a base 1 and a handle 2 attached thereto. At least one elastic pad 3 is connected to the outer surface of the base 1. The bat has protrusions 4 facing outwards from the elastic pad 3, evenly distributed and connected to the pad. The protrusions 5 are made T-shaped in their cross sections, in the form of a leg 5 and a head 6 combined with the leg 5. The legs 5 are connected to the elastic pad 3, and the heads 6 of the neighboring T-shaped protrusions are brought into contact to each other.

Figure 3:
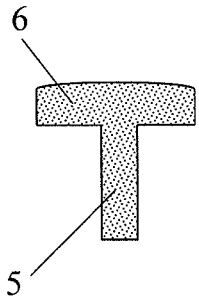
FIG. 3 shows a longitudinal section of a protrusion having a convex head.
Figure 4:
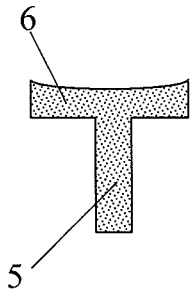
FIG. 4 shows a longitudinal section of a protrusion having a concave head.

The surface of the head 6, as facing outwards, may be made convex (FIG. 3) or concave (FIG. 4).

Figure 5:
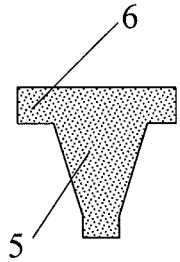
FIG. 5 shows a longitudinal section of a protrusion having a thickening leg.

The leg 5 of the T-shaped protrusion may be made thickening in the direction of the head 6 (FIG. 5).

Figure 6:
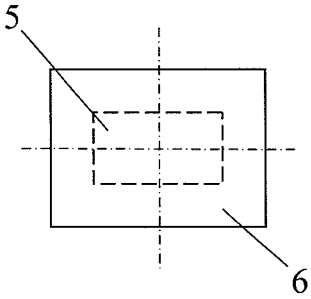
FIG. 6 shows a top view of a protrusion, when the T-shaped protrusion leg and head are made rectangular in their cross-sections.

The leg 5 and the head 6 of the T-shaped protrusions may be made rectangular in their cross-sections (FIG. 6).

Figure 7:
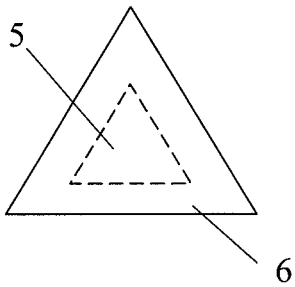
FIG. 7 shows a view of a protrusion, when the T-shaped protrusion leg and head are made triangular in their cross-sections.

The leg 5 and the head 6 of the T-shaped protrusions may be made triangular in their cross-sections (FIG. 7).

Figure 8:
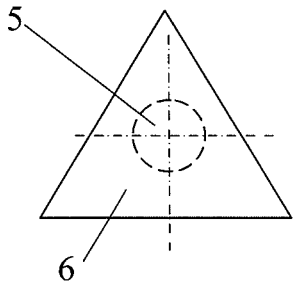
FIG. 8 shows a view of a protrusion, when the T-shaped protrusion leg is made circular in its cross-section and the head is made triangular in its cross-section.

The leg 5 of the T-shaped protrusion may be made circular in its cross-section, and the head 6 of the T-shaped protrusion may be made triangular in its cross-section (FIG. 8).

Figure 9:
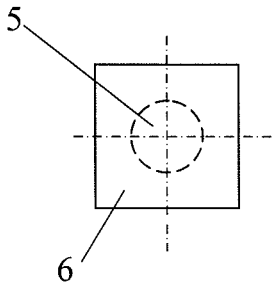
FIG. 9 shows a top view of a protrusion, when the T-shaped protrusion leg is made circular in its cross-section and the head is made square in its cross-section.

The leg 5 of the T-shaped protrusion may be made circular in its cross-section, and the head 6 of the T-shaped protrusion may be made square in its cross-section (FIG. 9).

Figure 10:
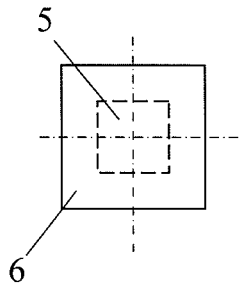
FIG. 10 shows a view of a protrusion, when the T-shaped protrusion leg and head are made square in their cross-sections.

The leg 5 and the head 6 of the T-shaped protrusions may be made square in their cross-sections (FIG. 10).

Figure 2:
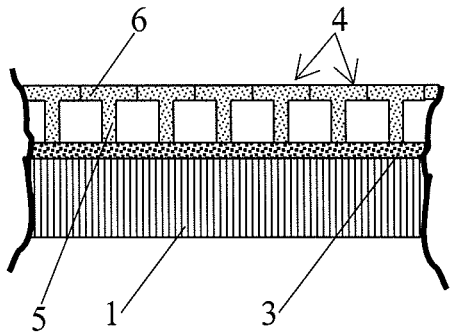

The T-shaped protrusions may be distributed in the staggered order (FIG. 1).

The elastic pad 3 and the T-shaped protrusions may be made, in particular, of the same material, for example a synthetic material.

The material of the base 1 is a natural wood, the materials for the elastic pad 3 are those that are conventionally used in the art for making bats, i.e. fiber glass, carbon fiber, cellular (expanded) rubber, elastic titanium, carbon synthetic materials of Kevlar type and the like.

The bat (FIGS. 1, 2) works as follows.

The elastic pad 3 with the protrusions 4 is arranged either on both sides of the blade-shaped base 1 or on its one side, for amateur and professional table tennis, respectively. A covering material must cover the blade-shaped base 1 completely without extending beyond its edges, except for the part adjoining the handle 2 and clasped by fingers. This part may be covered by any material or may be left uncovered and should be regarded as a part of the handle 2.

The base 1, any elastic layer 3 or a layer of any covering or bonding material on the side used for striking a ball should have equal thicknesses. A thickness of the elastic layer 3 should not be more than 0.35 mm. A thickness of the elastic layer 3 with the protrusions 4 should be up to 0.2 mm, inclusively.

The surfaces of the blade side covering material or the blade side left uncovered should be uniformly painted and matt: one side should be black and the other one vermilion.

When a flying ball contacts the protrusions 4 that are made T-shaped, they are deformed, which results time of holding the ball on the bat is increased. The T-shaped protrusions enable to improve, as compared to the closest analogous solution, the cushioning properties, increase ball flying speed and improve the possibility of twisting it due to increasing both an area and an angle of possible contact between a ball and the protrusions 4. The ball "sensing" and its control are improved without significant loss in a speed of the ball.

In order to further improve quality of twisting, the outer surface of the head 6 may be made convex (FIG. 3) or concave (FIG. 4).

In order to further increase a flying speed of a bouncing ball, the leg 5 of the T-shaped protrusion may be made thickening in the direction of the head 6 (FIG. 5).

In order to improve stability of striking a ball, the protrusions 4 are distributed in the staggered order (FIG. 1).

The proposed table tennis bat may be most advantageously applied in conducting amateur or professional table-tennis games.

What is claimed is:

1. A table tennis bat comprising: a base, a handle attached to it, at least one elastic pad connected to the outer base surface, protrusions facing outwards from the elastic pad, evenly distributed and connected thereto, characterized in that the protrusions in their cross-section are made T-shaped in the form of a leg and a head combined with the leg, the legs being connected to the elastic pad, and the heads of the neighboring T-shaped protrusions being brought into contact therebetween.

2. A bat according to claim 1, characterized in that the head surface facing outwards is made convex.

3. A bat according to claim 1, characterized in that the head surface facing outwards is made concave.

4. A bat according to claim 1, characterized in that the leg of the T-shaped protrusion is made thickening in the direction of the head.

5. A bat according to claim 1, characterized in that the leg and the head of the T-shaped protrusions are made rectangular in their cross-sections.

6. A bat according to claim 1, characterized in that the leg and the head of the T-shaped protrusions are made triangular in their cross-sections.

7. A bat according to claim 1, characterized in that the leg of the T-shaped protrusion is made circular in its cross section and the head of the T-shaped protrusion is made triangular in its cross-section.

8. A bat according to claim 1, characterized in that the leg of the T-shaped protrusion is made circular in its cross-section and the head of the T-shaped protrusion is made square in its cross-section.

9. A bat according to claim 1, characterized in that the leg and the head of the T-shaped protrusions are made square in their cross-sections.

10. A bat according to claim 1, characterized in that the T-shaped protrusions are distributed in the staggered order.

11. A bat according to claim 1, characterized in that the elastic pad and the T-shaped protrusions are made of the same material.

* * * * *